US007823735B2

(12) United States Patent
Dunn

(10) Patent No.: US 7,823,735 B2
(45) Date of Patent: Nov. 2, 2010

(54) HANDLE RACK

(75) Inventor: Wesley Owens Dunn, Mount Juliet, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 12/324,187

(22) Filed: Nov. 26, 2008

(65) Prior Publication Data

US 2009/0071464 A1 Mar. 19, 2009

Related U.S. Application Data

(62) Division of application No. 11/085,743, filed on Mar. 21, 2005, now Pat. No. 7,472,796.

(60) Provisional application No. 60/558,271, filed on Mar. 31, 2004.

(51) Int. Cl.
*A47F 5/08* (2006.01)

(52) U.S. Cl. ..... 211/153; 211/90.03

(58) Field of Classification Search ..... 211/153, 211/90.03, 41.4, 126.15, 134, 90.01, 181.1; D7/409, 323, 388, 402; 126/337 R, 332, 126/337 A, 338, 339
See application file for complete search history.

(56) References Cited

U.S. PATENT DOCUMENTS 1,925,371 A * 9/1933 Charter ..... 211/153
2,751,486 A 6/1956 Evans
2,806,467 A 9/1957 Slaughter
3,027,016 A 3/1962 Becht
D205,716 S * 9/1966 Christoffersen ..... D7/409
3,450,025 A 6/1969 Fleming
4,651,713 A 3/1987 Ondrasik, II
5,351,842 A 10/1994 Remmers
5,447,146 A 9/1995 Nickerson
D426,749 S * 6/2000 Barnes et al. ..... D7/409
6,086,035 A 7/2000 Trifilio
6,112,916 A 9/2000 Barnes et al.
6,328,170 B1 12/2001 Lee
6,349,717 B1 2/2002 Thompson et al.
6,644,302 B1 11/2003 Bartley
6,926,001 B2 8/2005 Bartley
D510,839 S * 10/2005 Shin ..... D7/409
7,472,796 B2 * 1/2009 Dunn ..... 211/153
2004/0091413 A1 * 5/2004 Otsuka et al. ..... 423/352
2006/0027516 A1 2/2006 Chen

* cited by examiner

*Primary Examiner*—Jennifer E. Novosad
(74) *Attorney, Agent, or Firm*—Pearne & Gordon LLP

(57) ABSTRACT

A handle rack includes a frame having first and second side edges and front and rear crossbars. A plurality of bar extend between portions of the frame. A handle cross-member is disposed rearwardly of the front crossbar and has a first end secured to the first side edge of the frame and a second end secured to the second side edge of the frame. At least one strengthening bar is provided which has a first portion coupled to the front crossbar and a second portion coupled to the handle cross-member.

3 Claims, 3 Drawing Sheets

HANDLE RACK

CROSS REFERENCE TO RELATED APPLICATIONS

This application is a divisional of U.S. application Ser. No. 11/085,743 filed on Mar. 21, 2005 which claims the benefit of U.S. Provisional Patent Application Ser. No. 60/558,271, filed on Mar. 31, 2004. These applications are incorporated herein by reference.

BACKGROUND OF THE INVENTION

1) Field of the Invention

The present invention relates to racks for appliances, and more particularly, to a rack having a handle portion.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a handle rack is provided. The handle rack includes a frame having first and second side edges and front and rear crossbars; a plurality of bars extending between portions of the frame; a handle cross-member disposed rearwardly of the front crossbar and having a first end secured to the first side edge of the frame and a second end secured to the second side edge of the frame; and at least one strengthening bar having a first end secured to the front crossbar and a second end secured to the rear crossbar.

In accordance with another aspect of the present invention, a handle rack is provided which includes: a frame having first and second side edges and front and rear crossbars; a plurality of bars extending between portions of the frame; a handle cross-member disposed rearwardly of the front crossbar having a first end secured to the first side edge of the frame and a second end secured to the second side edge of the frame; and at least one strengthening bar having a first portion coupled to the front crossbar and a second portion coupled to the handle cross-member.

In accordance with yet another aspect of the present invention, a handle rack is provided which includes: a frame having first and second side edges and front and rear crossbars; a plurality of bars extending between portions of the frame; at least one strengthening cross-member having a first end secured to the first side edge of the frame and a second end secured to the second side edge of the frame; a handle cross-member disposed rearwardly of the front crossbar having a first end secured to the first side edge of the frame and a second end secured to the second side edge of the frame; and at least one strengthening bar having a first end secured to the front crossbar and a second end secured to the at least one strengthening cross-member.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
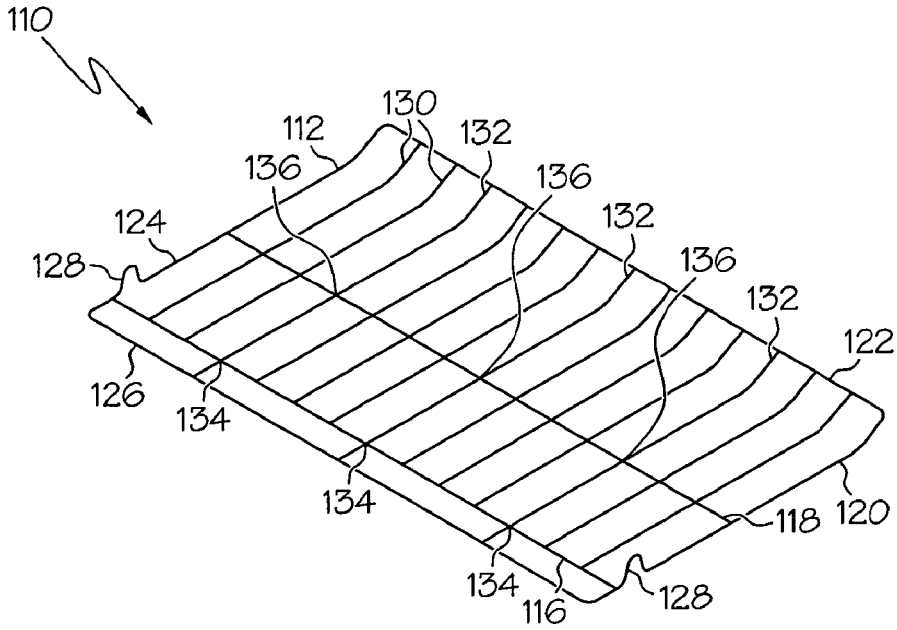
FIG. 1 illustrates a perspective view of an example of a handle rack in accordance with an aspect of the present invention.

The present invention relates to a handle rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Referring initially to FIG. 1, an example of a handle rack 110 for an oven is illustrated in accordance with an aspect of the present invention. The handle rack 110 includes a frame 112, a plurality of bars 130, 132, a handle cross-member 116, and one or more optional strengthening cross-members 118. The frame 112, bars 130, 132, and cross-member(s) 116, 118 can be manufactured from steel or any other suitable material which provides adequate strength to support items such as cake pans, pizza stones and casseroles and withstands the heat of an oven. The handle rack 110 can be formed by bending a continuous wire into a substantially rectangular shape to form the frame 112. The frame 112 comprises a first side edge 120, a rear crossbar 122, a second side edge 124, and a front crossbar 126. The first and second side edges 120, 124 have an upward-facing projection 128 integrally formed in the wire frame of the handle rack 110 to facilitate alignment of the rack within an oven (not shown). For instance, a standard rack location in an oven includes a top guide rail and a bottom guide rail. The top guide rail includes a downward-facing projection and the bottom guide rail includes a corresponding downward-facing groove portion. Specifically, the upward-facing portion 128 of the handle rack 110 is adapted to contact the downward-facing projection of the top guide rail such that a stop is created to properly align the oven rack 110 with respect to the top and bottom guide rails.

The plurality of bars are also formed from wire and include a plurality of support bars 130 of a first length and one or more strengthening bars 132 of a second length. In particular, the support bars 130 have a length that extends between the rear crossbar 122 of the frame 112 and the handle cross-member 116 such that the support bars 130 each have a first end welded, or otherwise secured, to the rear crossbar 122 and a second end welded, or otherwise secured, to the handle cross-member 116. The strengthening bar(s) 132 has a length that extends between the rear crossbar 122 of the frame 112 and the front crossbar 126 of the frame 112 such that the strengthening bar(s) 132 has a first end welded, or otherwise secured, to the rear crossbar 122 and a second end welded, or otherwise secured, to the front crossbar 126. The strengthening bar(s) 132 can also be welded to the handle cross-member 116 and strengthening cross-member(s) 118 at corresponding mating points 134, 136. The strengthening bar(s) 132 operates to mitigate sagging of the central rack portion with respect to the front crossbar 126 when heavy food or cookware is placed on the rack 110. Sagging of the central portion of the rack 110 presents problems with easily sliding the food or cookware from the rack 110 without interference from the front crossbar 126.

In the present example, three strengthening bars 132 extend between the rear crossbar 122 and the front crossbar 126 and are spaced substantially equidistant from one another and substantially parallel with the first and second side edges 120 and 124. The gap between the handle cross-member 116 and the front crossbar 126 creates a handle portion to facilitate pulling out and/or removing the rack 110 from an oven. The handle portion extends across an entire length of the rack 110 such that when the rack 110 is in use, at least a portion of the handle is always exposed. For instance, if a cookie sheet is placed at a center portion of the rack 110, the cookie sheet will likely cover a central portion of the rack 110. Accordingly, because the length of handle portion extends across the entire length of the rack 110, a user can grab the handle from either or both end portions of the rack 110. The three strengthening bars 132 also act to define a plurality of grasping areas.

The handle cross-member 116 and the strengthening cross-member(s) 118 are also formed of wire and have a first end welded, or otherwise secured, to the first side edge 120 of the frame 112 and a second end welded, or otherwise secured, to the second side edge 124 of the frame 112. The handle cross-member 116 is disposed rearwardly of and positioned substantially parallel with the front crossbar 126 and is spaced from the front crossbar 126 at a distance such that a user can comfortably grasp the front crossbar 126 to pull the rack 110 from the oven. Thus, the front crossbar 126 acts as a handle for the rack 110. The strengthening cross-member(s) 118 is also positioned substantially parallel with the front crossbar 126 and acts to increase the strength of the handle rack 110. The wires can be coated with a glass material, such as porcelain, or any other suitable material operable to protect the handle rack 110 from discoloration and the like due to heating of the wire at high temperatures.

FIGS. 2-6 illustrate various configurations of handle racks 210, 310, 410, 510, and 610, respectively, in accordance with aspects of the present invention. The handle racks 210, 310, 410, 510, and 610 comprise the same basic configuration as the handle rack 110 shown in FIG. 1. In this respect, components of the handle racks 210, 310, 410, 510, and 610 that are analogous with the components of the handle rack 110 are referenced with corresponding reference numerals. For example, the substantially rectangular frame 112 of FIG. 1 is analogous with substantially rectangular frames 212, 312, 412, 512, and 612 of FIGS. 2, 3, 4, 5, and 6, respectively. For the sake of brevity, these analogous components will only be discussed with regard to any additional detail, or any differences from the previously discussed handle rack 110 shown in FIG. 1.

Figure 2:
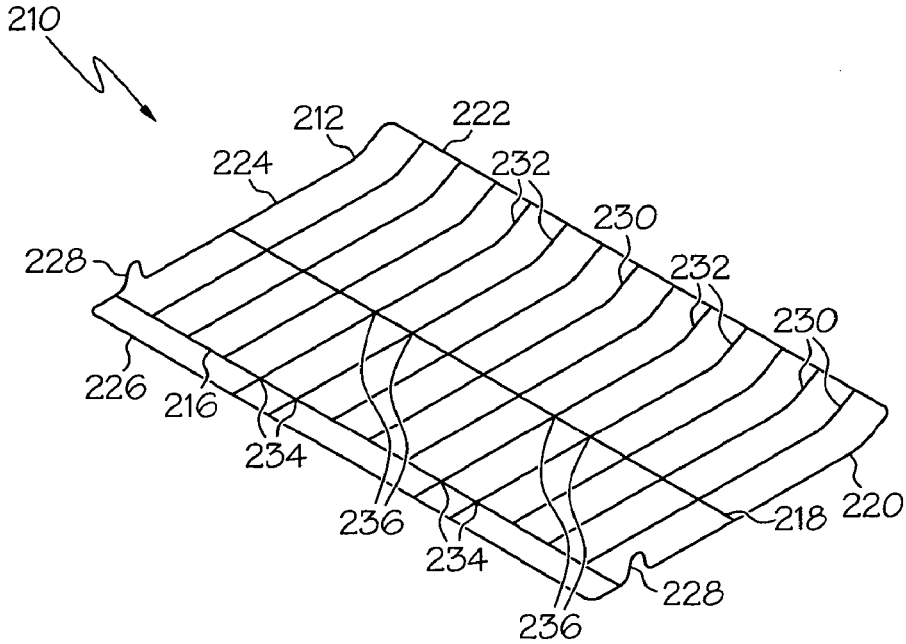
FIG. 2 illustrates a perspective view of another example of a handle rack in accordance with an aspect of the present invention.
Figure 3:
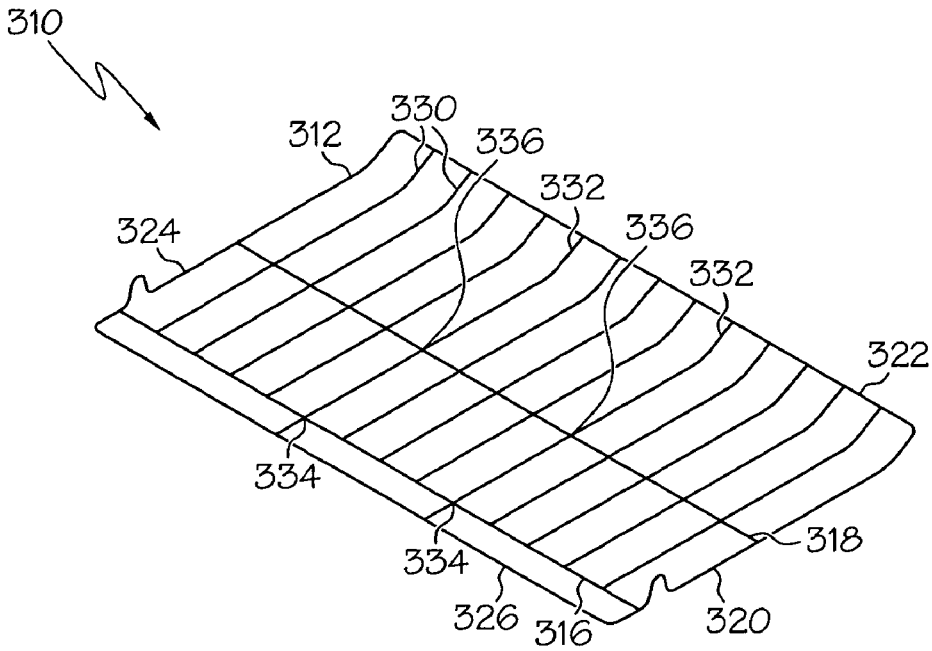
FIG. 3 illustrates a perspective view of another example of a handle rack in accordance with an aspect of the present invention.
Figure 4:
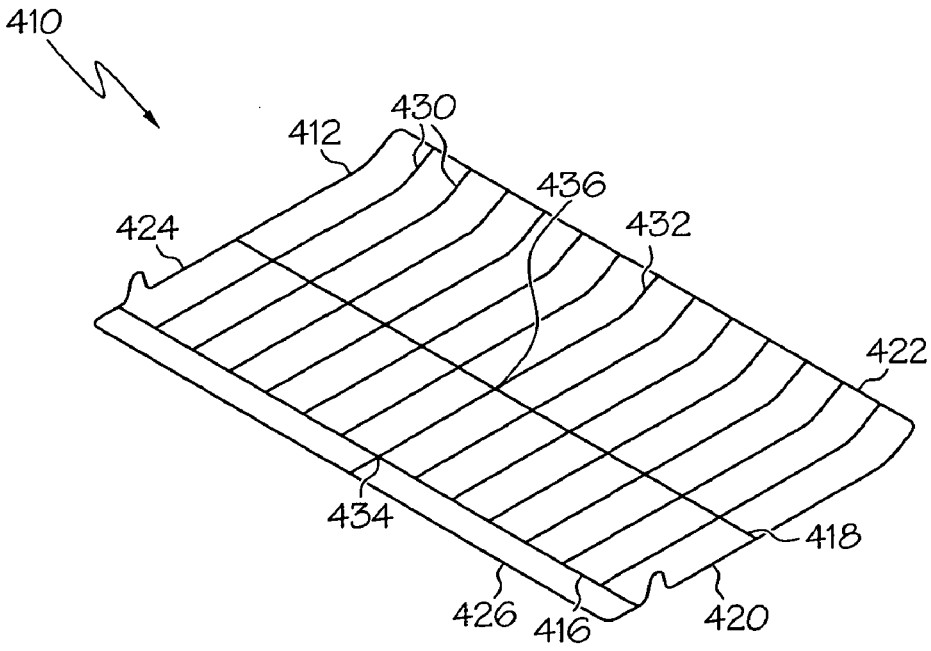
FIG. 4 illustrates a perspective view of another example of a handle rack in accordance with an aspect of the present invention.
Figure 5:
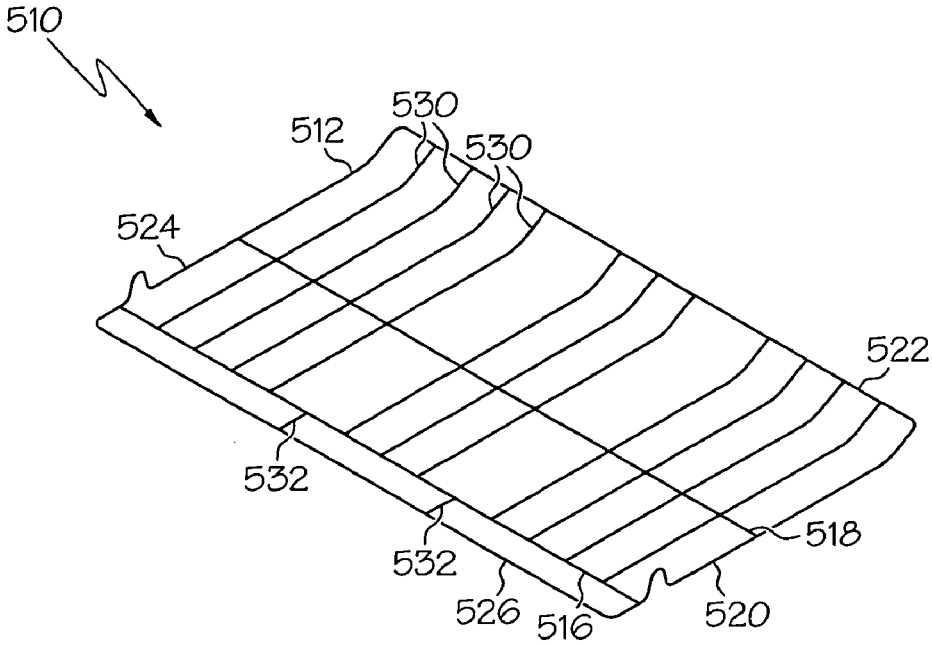
FIG. 5 illustrates a perspective view of another example of a handle rack in accordance with an aspect of the present invention.

Turning now to FIG. 2, a handle rack 210 is shown having four strengthening bars 232 extending between the rear crossbar 222 and the front crossbar 226 and spaced to define three grasping areas. FIG. 3 illustrates a handle rack 310 having two strengthening bars 332 extending between the rear crossbar 322 and the front crossbar 326 to define three grasping areas. FIG. 4 illustrates a handle rack 410 having one strengthening bar 432 extending between the rear cross bar 422 and the front crossbar 426 to define two grasping areas.

It is to be appreciated that a handle rack having any suitable number of strengthening bars spaced apart to define any suitable number of grasping areas is contemplated as falling within the scope of the present invention. Further, it is to be appreciated that the handle rack can have any suitable configuration such that the handle portion includes at least two defined grasping areas, which together, extend across an entire length of the rack so that when the rack is in use, at least a portion of the handle is always exposed Turning now to FIG. 5, a handle rack 510 having an alternative configuration of strengthening bars 532 is illustrated in accordance with an aspect of the present invention. In particular, the handle rack 510 includes one or more strengthening bars 532 that extend between the handle cross-member 516 and the front crossbar 526 such that a first end of the strengthening bar(s) 532 is welded, or otherwise secured, to the handle cross-member 516 and a second end of the strengthening bar(s) 532 is welded, or otherwise secured, to the front crossbar 526. Although, the handle rack 510 illustrates two strengthening bars 532, the handle rack 510 can include any suitable number of strengthening bars 532 positioned at any suitable location between the handle cross-member 516 and front crossbar 526 to define a plurality of grasping areas along the handle portion.

Figure 6:
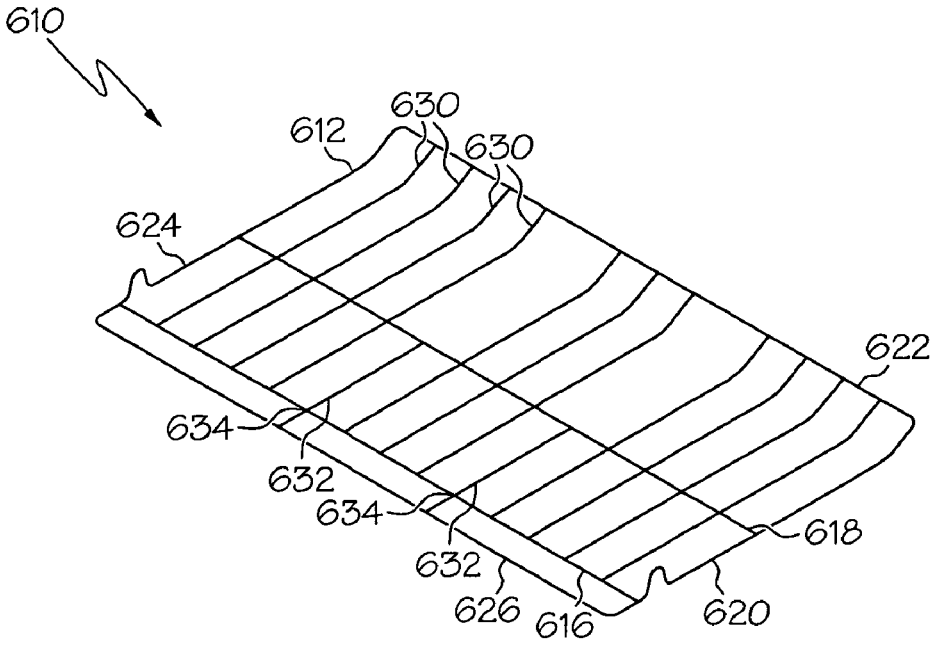
FIG. 6 illustrates a perspective view of another example of a handle rack in accordance with an aspect of the present invention.

FIG. 6 illustrates yet another example of a handle rack 610 having an alternative configuration of strengthening bars 632 in accordance with an aspect of the present invention. The handle rack 610 includes one or more of the strengthening bars 632 that extend between one or more strengthening cross-members 618 and the front crossbar 626 such that a first end of the strengthening bar(s) 632 is welded, or otherwise secured, to the cross-member 618 and a second end of the strengthening bar(s) 632 is welded, or otherwise secured, to the front crossbar 626. The strengthening bar(s) 632 can also be welded to the handle cross-member 616 at corresponding mating points 634. Again, although, the handle rack 610 illustrates two strengthening bars 632, the handle rack 610 can include any suitable number of strengthening bars 632 positioned at any suitable location between the cross-member 618 and front crossbar 626 to define a plurality of grasping areas along the handle portion.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the exemplified embodiment, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The handles on the rack of the subject invention can be made from the same material as the rack. For example, the handles can be fashioned from steel bars that are welded (e.g., spot welded) to the frame. Alternatively, the handles can be made of an insulated material to protect someone grasping the handle from burns. Suitable insulating materials include ceramics, which can likewise be applied to the handle to provide insulation qualities.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for an appliance comprising;

a frame having first and second side edges and front and rear crossbars, wherein the front crossbar has a first end secured to the first side edge and a second end secured to the second side edge;

a handle cross-member disposed rearwardly of the front crossbar, wherein the handle cross-member and the front crossbar lie within a single plane;

a strengthening cross-member having a first end secured to the first side edge and a second end secured to the second side edge;

a plurality of bars, wherein each of the plurality of bars has a first end secured to the handle cross-member and a second end secured to the rear crossbar; and at least one strengthening bar having a first end secured to the front crossbar and a second end secured to the rear crossbar, wherein the plurality of bars are oriented in a direction substantially parallel with the at least one strengthening bar, and wherein the plurality of bars and the at least one strengthening bar are of different lengths, and wherein a portion of the at least one strengthening bar is secured to the handle cross-member.

2. The rack of claim 1 having a plurality of strengthening bars, each having a first end secured to the front crossbar and a second end secured to the rear crossbar.

3. The rack of claim 1, wherein the first and second side edges each include an upward-facing projection integrally formed therein.

* * * * *